US007249961B1

(12) United States Patent
Provenzano

(10) Patent No.: US 7,249,961 B1
(45) Date of Patent: Jul. 31, 2007

(54) JACK ASSEMBLY AND METHOD OF PERFORMING ELECTRICAL COUPLING

(75) Inventor: Charles J. Provenzano, Houston, TX (US)

(73) Assignee: Direct Connect, Houston, TX (US)

( * ) Notice: Subject to any disclaimer, the term of this patent is extended or adjusted under 35 U.S.C. 154(b) by 0 days.

(21) Appl. No.: 11/462,239

(22) Filed: Aug. 3, 2006

(51) Int. Cl.
*H01R 4/24* (2006.01)
*H01R 4/26* (2006.01)
*H01R 11/20* (2006.01)

(52) U.S. Cl. ..... 439/409; 439/676

(58) Field of Classification Search ..... 439/409, 439/676

See application file for complete search history.

(56) References Cited

U.S. PATENT DOCUMENTS 4,975,078 A * 12/1990 Stroede et al. ..... 439/405
5,118,310 A * 6/1992 Stroede et al. ..... 439/676
5,431,586 A * 7/1995 Klas et al. ..... 439/676
5,762,518 A * 6/1998 Tanigawa et al. ..... 439/409
5,947,761 A * 9/1999 Pepe ..... 439/409
6,031,909 A * 2/2000 Daoud ..... 379/438
6,739,898 B1 * 5/2004 Ma et al. ..... 439/404
7,097,513 B2 * 8/2006 Bryan ..... 439/676

* cited by examiner

*Primary Examiner*—Hae Moon Hyeon
(74) *Attorney, Agent, or Firm*—Conley Rose, P.C.; Michael E. Ramon; Mark E. Scott

(57) ABSTRACT

A jack assembly and method for electrically coupling a jack assembly to a plurality of wires. At least some of the illustrative embodiments are jack assemblies comprising a first portion, a second portion hingedly coupled to the first portion, and a wire guide configured to detachably couple within an internal cavity defined by the first and second portions (the wire guide defining an aperture, wherein the aperture is configured to receive a plurality of wires). The jack assembly is configured to electrically couple to the plurality of wires when the first portion is closed onto the second portion by way of the hinged coupling.

20 Claims, 3 Drawing Sheets

JACK ASSEMBLY AND METHOD OF PERFORMING ELECTRICAL COUPLING

BACKGROUND

Installing a digital communications network or an analog phone network involves stripping an outer jacket of cable to expose a plurality of wires (e.g., twisted-pair wires) and terminating the plurality of wires into a variety of jacks for subsequent interfacing with a variety of plugs (such as Registered Jack 45 (RJ-45) plug for a data connection or an RJ-11 plug for a phone connection). Regardless of the type of jack used to terminate the plurality of wires, a tool (e.g., a 110 punch down tool) is used to terminate the plurality of wires within the jack. Use of such specialized tools may call for specialized training, may take significant time to use, and may result in tool-related injuries.

SUMMARY

The problems noted above are solved in large part by a jack assembly and method for electrically coupling a jack assembly to a plurality of wires. At least some of the illustrative embodiments are jack assemblies comprising a first portion, a second portion hingedly coupled to the first portion, and a wire guide configured to detachably couple within an internal cavity defined by the first and second portions (the wire guide defining an aperture, wherein the aperture is configured to receive a plurality of wires). The jack assembly is configured to electrically couple to the plurality of wires when the first portion is closed onto the second portion by way of the hinged coupling.

Other illustrative embodiments are methods comprising passing a plurality of wires through a wire guide, inserting the wire guide into a first member of a jack assembly, and closing the first member of the jack assembly onto a second member (and thereby electrically coupling the jack assembly to the plurality of wires).

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

NOTATION AND NOMENCLATURE

Certain terms are used throughout the following description and claims to refer to particular system components. This document does not intend to distinguish between components that differ in name but not function.

In the following discussion and in the claims, the terms "including" and "comprising" are used in an open-ended fashion, and thus should be interpreted to mean "including, but not limited to . . . ". Also, the term "couple" or "couples" is intended to mean either an indirect or direct connection. Thus, if a first device couples to a second device, that connection may be through a direction connection, or through an indirect connection via other devices and connections.

DETAILED DESCRIPTION

Figure 1:
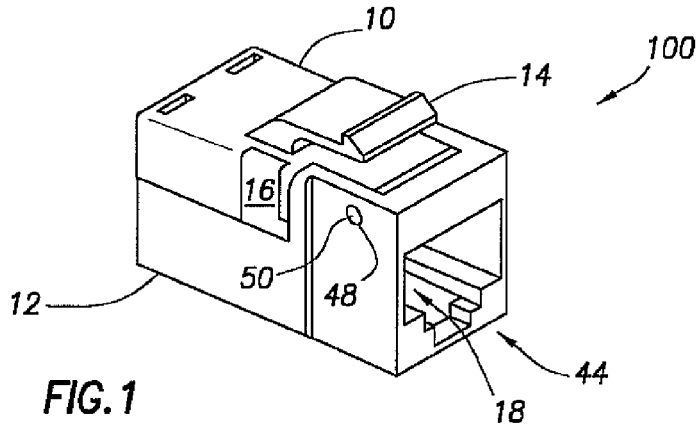
FIG. 1 is a front perspective view of a jack assembly in accordance with embodiments of the invention.

FIG. 1 illustrates a jack assembly 100 comprising a first portion 10 or member and a second portion 12 or member hingedly coupled to the first portion 10 by way of a hinge formed from an aperture 48 (of the second portion 12), an aperture 52 (FIG. 2; of the first portion 10), and a pin 50 configured to couple within the apertures 48 and 52. The first portion 10 comprises a clip or latch 14 that is configured to couple the jack assembly 100 to a decorative faceplate. The second portion 12 has a first end 44 that comprises an external connector receiving slot 18. The external connector receiving slot 18 is configured to receive an electrical plug such as a Registered Jack 45 (RJ-45) plug that may be used for data transfer. In alternative embodiments, the external connector receiving slot 18 may be configured to receive other electrical plugs as defined by the Universal Service Ordering Code (USOC) such as RJ-11, RJ-14, RJ-25, RJ-48, or RJ61, among others, which may be used for single- or multiple-line phone or data connections.

The plugs, in addition to being configured for different uses, are also physically constructed with varying numbers of electrically conductive pins that are configured to electrically couple to the jack assembly 100 by way of the external connector receiving slot 18. Likewise, in alternative embodiments, the jack assembly 100 may be configured with a varying number of electrically conductive contact members 38 (FIG. 2) and with a varying number of channels 26 (FIGS. 2 and 3A) so as to accommodate different types of plugs. The electrical plugs are used to terminate electrical cables that comprise a plurality of wires (e.g., twisted-pair wire) such as a Category 5 (CAT5), a Category 5e (CAT5e), a Category 6 (CAT6), or a Category 6a (CAT6a) cable, among others, as defined by standards set forth by the Telecommunications Industry Association and the Electronic Industries Association, such as TIA/EIA-568A or TIA/EIA-568B. As an example, the RJ-45 plug has eight (8) electrically conductive pins and is therefore configured to couple to an electrical cable comprising eight (8) wires (or four (4) twisted-pairs). Further, the plugs and/or the jack assembly 100 may be configured for various wiring schemes such as straight-through or crossover wiring.

Figure 2:
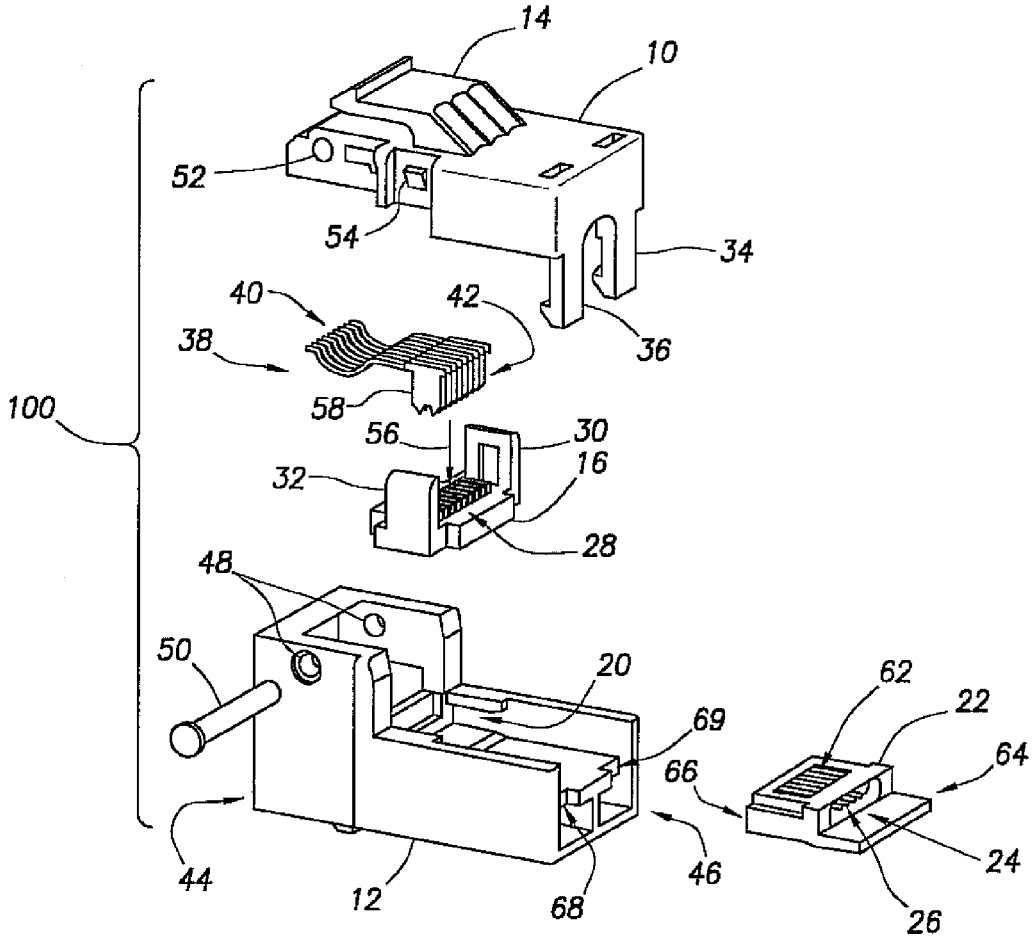
FIG. 2 is a rear perspective, exploded view of a jack assembly in accordance with embodiments of the invention.
Figure 3A:
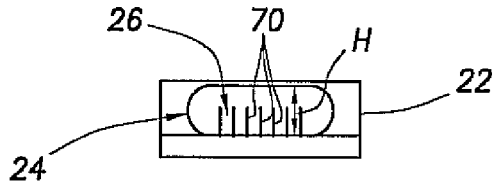
FIG. 3 is various views of a wire guide in accordance with embodiments of the invention.

FIG. 2 illustrates an exploded view of the jack assembly 100 of FIG. 1. As shown in FIG. 2, the first portion 10 comprises the aperture 52, which together with the aperture 48 (of the second portion 12) and the pin 50, comprise the hinge by which the first portion 10 and the second portion 12 are hingedly coupled to each other. A retaining element 16 comprises a first locking tab 30, a second locking tab 32, and a plurality of slots 28. The jack assembly 100 further comprises a plurality of electrically conductive contact members 38 comprising a first end 40 and a second end 42. The first end 40 of each of the plurality of electrically conductive contact members 38 is configured to electrically couple to an electrically conductive pin of a plug (e.g., an RJ-45 plug) by way of the external connector receiving slot 18 (not visible in FIG. 2). The second end 42 of each of the plurality of electrically conductive contact members 38 is terminated by a sharp edge 58 which is configured to pierce a wire's insulation and make electrical contact to a subsequently exposed wire. Further, as indicated by directional arrow 56, the second end 42 of the plurality of electrically conductive contact members 38 is configured to detachably couple within a plurality of slots 28 of the retaining element 16. The plurality of electrically conductive contact members 38 is maintained in a substantially fixed position (abutting the first portion 10) by the retaining element 16. Specifically, the first locking tab 30 and the second locking tab 32 are configured to couple to a first tab (not shown) and a second tab 54 of the first portion 10, respectively, and as illustrated in FIG. 1.

Still referring to FIG. 2, the second portion 12 also comprises a second end 46 having a wire guide receiving slot 20. Accordingly, the jack assembly 100 further comprises a wire guide 22 having a first end 64 and a second end 66. The wire guide 22 is configured to detachably couple within an internal cavity defined by the first portion 10 and the second portion 12. Specifically, the wire guide 22 is configured to couple within the wire guide receiving slot 20.

FIG. 3 provides a more detailed view of some exemplary embodiments of the wire guide 22. As shown in FIG. 3A, which is an elevational end view of the first end 64, the wire guide 22 defines an aperture 24 which is configured to receive a plurality of wires, such as the twisted-pair wire that may be comprised within a variety of electrical cables (discussed above). Further, the aperture 24 defines a plurality of channels 26, wherein each channel is independent of adjacent channels (separated by an insulating barriers 70) and wherein each channel is configured to receive a wire of the plurality of wires. FIG. 3A shows the insulating barriers 70 partially spanning a height 'H' of the aperture 24; however, in alternative embodiments, the insulating barriers 70 may span the entire height of the aperture 24. In some exemplary embodiments, the plurality of channels 26 may be alternatively formed, for example, by using circular insulating barriers.

Figure 3B:
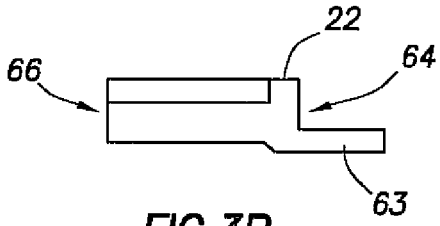
Figure 3C:
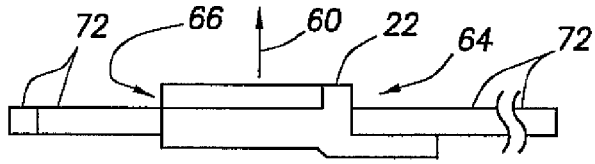
Figure 3F:
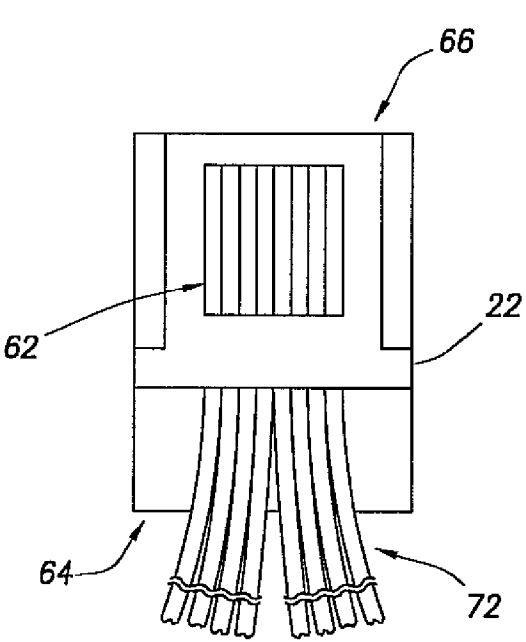
Figure 3E:
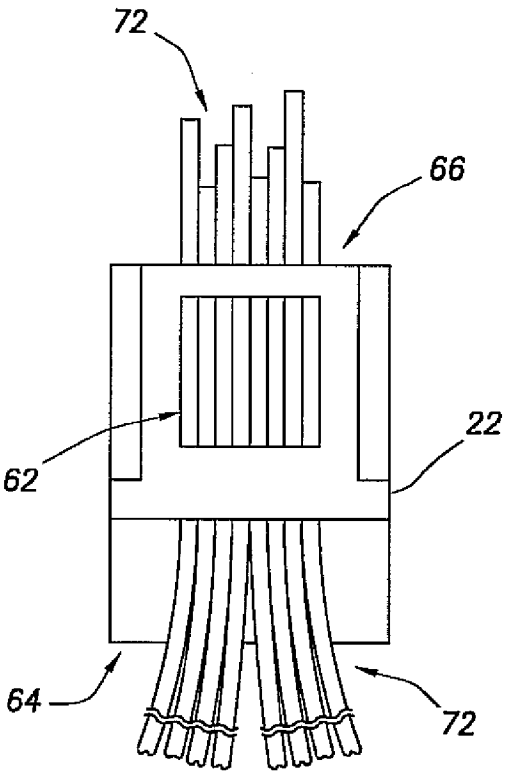
Figure 3D:
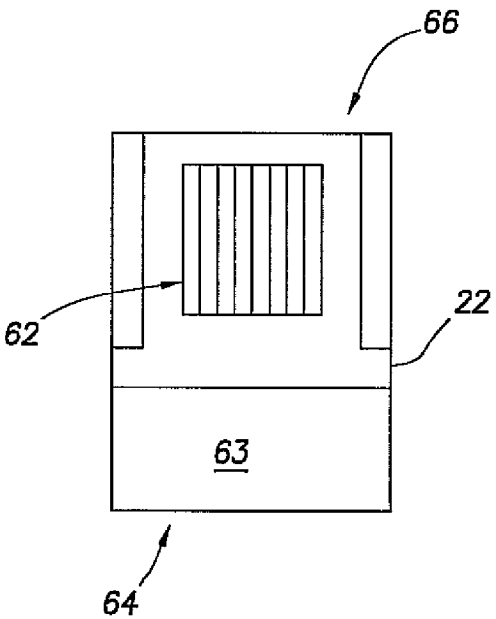

The wire guide 22 is also configured to maintain the plurality of wires substantially in a fixed relationship within the plurality of channels 26. This may be accomplished by: the circumscribed nature of the aperture 24; the size of the aperture 24; or the size and/or spacing of the plurality of channels 26. As an example, FIGS. 3B and 3C illustrate, respectively, a side view of the wire guide 22 without and with a plurality of wires 72 installed. Similarly, FIGS. 3D and 3E show, respectively, a top view of the wire guide 22 without and with the plurality of wires 72 installed. As seen in FIGS. 3C and 3E, the plurality of wires 72 enter the wire guide 22 through the first end 64 and in some embodiments exit through the second end 66. Further, the plurality of wires 72 are maintained in a substantially fixed relationship within the plurality of channels 26. Specifically, the circumscribed nature of the aperture 24 keeps the plurality of wires 72 from dislodging themselves through slots 62 (discussed below) in the direction indicated by arrow 60 of FIG. 3C. Also, the size of the aperture 24 and the size and/or spacing of the plurality of channels 26 may provide a frictional force with respect to the plurality of wires 72 that is sufficient to restrict movement.

FIGS. 3C and 3E also illustrate that the plurality of wires 72 protruding from the second end 66 may be of differing lengths. The lengths by which each of the plurality of wires 72 protrude may not be important as they may be trimmed to be flush (or nearly flush) with the second end 66 of the wire guide 22 as shown in FIG. 3F. The trimming is completed before inserting the wire guide 22 into the wire guide receiving slot 20 so as to remove potential obstructions caused by the protruding wires. Inasmuch as the lengths of the plurality of wires 72 need not be carefully measured, installing the plurality of wires 72 into the wire guide 22 with subsequent trimming may be advantageous over existing jack assemblies that call for ensuring proper wire length during the stripping of a cable and/or during the cutting of wire (e.g., twisted-pair wire) before installation into a jack assembly.

As shown in FIGS. 2 and 3D-3F, the wire guide 22 also comprises a plurality of slots 62 that are configured to receive the second end 42 of the plurality of electrically conductive contact members 38. In particular, the electrically conductive contact members 38 are configured to electrically couple to the plurality of wires 72 in the wire guide 22 when the first portion 10 is rotated about the hinged coupling. For example, when one end of the plurality of wires 72 have been installed in the wire guide 22 and the wire guide 22 coupled within the wire guide receiving slot 20, the first portion 10 is closed onto the second portion 12 such that the sharp edge 58 of each of the electrically conductive contact members 38 is configured to pass through the plurality of slots 62 and pierce the insulation of a respective one of the plurality of wires 72, thus making electrical contact to the subsequently exposed wires and electrically coupling the jack assembly 100 to the plurality of wires 72. In addition to receiving the second end 42 of the plurality of electrically conductive contact members 38, the plurality of slots 62 allow for visual verification of whether the correct wire (as determined by the color of the wire) has been led through the correct channel of the wire guide 22. In order to assist the installer, the various wire colors that should be within particular channels 26 may be indicated and visible in some way through the plurality of slots 62, or on tab portion 63.

Referring again to FIG. 2, when the first portion 10 is closed onto the second portion 12, the first portion 10 may also be locked to the second portion 12 by way of a first locking member 34 and a second locking member 36. Specifically, the first locking member 34 and the second locking member 36 are configured to lock onto notched edges 68 and 69 of the second portion 12. The locking is configured to provide the jack assembly 100 with mechanical stability and help ensure proper electrical communication between the jack assembly 100 and the plurality of wires 72.

Figure 4:
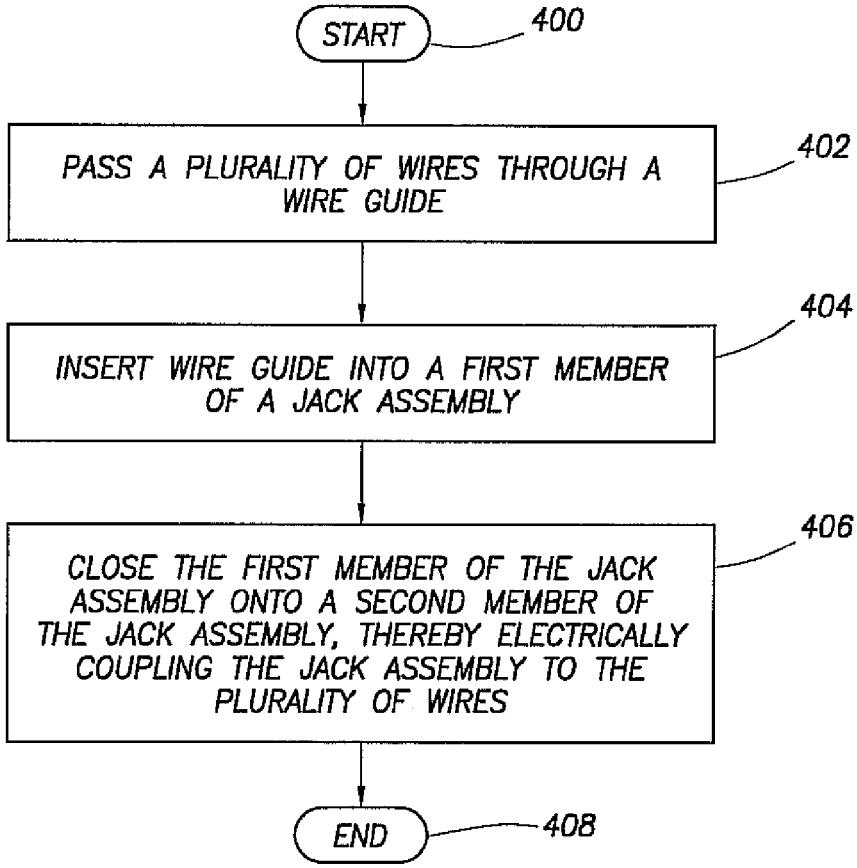
FIG. 4 is an exemplary flow diagram for coupling a jack assembly to a plurality of wires.

FIG. 4 shows an exemplary flow diagram of a method used for coupling a jack assembly to a plurality of wires in accordance with embodiments of the invention. The process starts (block 400) and proceeds to passing a plurality of wires through the wire guide 22 (block 402). Passing the wires through the wire guide 22 may comprise trimming a jacket of a cable to expose the plurality of wires, and then passing the wires into the wire guide 22 through the aperture 24. The passing may further comprise passing the plurality of wires through the plurality of channels 26 disposed within the aperture 24 of the wire guide 22. The passing of the plurality of wires may be accomplished by an individual in any manageable position as determined by the individual as the wire guide 22 may be removed from the jack assembly 100 and may also be oriented in any direction during the passing of the plurality of wires through the wire guide 22. In some exemplary embodiments, the individual may set the wire guide 22 on a supportive surface (e.g., a table top) during the passing of the plurality of wires through the wire guide 22. Additionally, the plurality of wires may be maintained by the wire guide 22 in a substantially fixed relationship within the plurality of channels 26. Illustratively, in other exemplary embodiments, excess wire protruding from the second end 66 of the wire guide 22 may be trimmed so that the wire guide 22 may properly couple within the jack assembly 100 without any obstruction that may be caused by the excess wire. The process then proceeds to inserting the wire guide 22 into a first member of the jack assembly 100 (block 404). The inserting may comprise inserting the wire guide 22 into the wire guide receiving slot 20. The process continues by closing the first member or portion of the jack assembly 100 onto a second member or portion of the jack assembly 100, thereby electrically coupling the jack assembly 100 to the plurality of wires (block 406). This process of electrically coupling the jack assembly 100 to the plurality of wires by closing the first member onto the second member is a manual process that does not call for specialized tools or equipment (e.g., a 110 punch down tool) to terminate a wire within a jack. Thus, this simplified manual process may reduce installation time and help avert tool-related injuries.

As discussed above, the closing of the first member onto the second member may be accomplished by way of the hinged coupling. Moreover, the first and second members may be locked to each other by way of the first locking member 34 and the second locking member 36. Additionally, the electrical coupling of the jack assembly 100 to the plurality of wires may be accomplished by way of the plurality of electrically conductive contact members 38 coupled within the jack assembly 100, wherein each of the plurality of electrically conductive contact members 38 have a first end 40 configured to electrically couple to a plug (e.g., an RJ-45 plug) by way of the external connector receiving slot 18 and a second end 42 configured to electrically couple to the plurality of wires by way of the sharp edge 58 of the second end 42 of each of the electrically conductive contact members 38. The process then stops (block 408).

The above discussion is meant to be illustrative of the principles and various embodiments of the present invention. Numerous variations and modifications will become apparent to those skilled in the art once the above disclosure is fully appreciated. For example, in some exemplary embodiments, the jack assembly 100 may be keyed or non-keyed, wherein a keyed jack assembly 100 comprises a notch within the external connector receiving slot 18 (FIG. 2). In like manner, the plugs may be keyed or non-keyed, wherein a keyed plug comprises a nodule configured to couple within the notch of the external connector receiving slot 18 of a keyed jack assembly 100. Thus, the keyed jack assembly 100 is configured to receive both keyed and non-keyed plugs while a non-keyed jack assembly 100 is configured to only receive non-keyed plugs. It is intended that the following claims be interpreted to embrace all such variations and modifications.

What is claimed is:

1. A jack assembly comprising:

a first portion;

a second portion hingedly coupled to the first portion; and a wire guide configured to detachably couple within an internal cavity defined by the first and second portions, the wire guide defining an aperture, wherein the aperture is configured to receive a plurality of wires such that excess wire protrudes from an end of the wire guide;

wherein the jack assembly is configured to electrically couple to the plurality of wires when the first portion is closed onto the second portion by way of the hinged coupling, and wherein the wire guide is configured to remain in a substantially fixed position while the first portion is closed onto the second portion.

2. The jack assembly as defined in claim 1 wherein the second portion comprises a first end having an external connector receiving slot and a second end having a wire guide receiving slot.

3. The jack assembly as defined in claim 2 wherein the wire guide is configured to couple within the wire guide receiving slot.

4. The jack assembly as defined in claim 1 wherein the aperture comprises a plurality of channels configured to receive the plurality of wires.

5. The jack assembly as defined in claim 4 wherein the wire guide maintains the plurality of wires substantially fixedly positioned within the plurality of channels.

6. The jack assembly as defined in claim 1 further comprising a retaining element having a plurality of slots and a first locking tab, wherein the first portion comprises a first tab, and wherein the retaining element is configured to couple to the first portion by way of the first locking tab engaging with the first tab.

7. The jack assembly as defined in claim 6 further comprising a plurality of electrically conductive contact members detachably coupled within the plurality of slots.

8. The jack assembly as defined in claim 7 wherein each of the plurality of electrically conductive contact members have a first end configured to electrically couple to an external connector by way of an external connector receiving slot and a second end configured to electrically couple to the plurality of wires.

9. The jack assembly as defined in claim 1 wherein the first portion comprises a first locking member, wherein the second portion comprises a first notched edge, and wherein the first portion and the second portion are configured to lock to each other by way of the first locking member engaging with the first notched edge.

10. The jack assembly as defined in claim 1 wherein the first portion comprises a clip configured to couple the jack assembly to a decorative faceplate.

11. A method comprising:

passing a plurality of wires through a wire guide such that excess wire protrudes from an end of the wire guide;

inserting the wire guide into a first member of a jack assembly; and closing the first member of the jack assembly onto a second member, thereby electrically coupling the jack assembly to the plurality of wires;

wherein the wire guide is configured to remain in a substantially fixed position while the first member is closed onto the second member.

12. The method as defined in claim 11 wherein the passing further comprises passing the plurality of wires through an aperture defined by the wire guide.

13. The method as defined in claim 12 wherein the passing further comprises passing the plurality of wires through a plurality of channels disposed within the aperture of the wire guide.

14. The method as defined in claim 11 wherein inserting further comprises inserting the wire guide into the first member comprising a first end having an external connector receiving slot and a second end having a wire guide receiving slot.

15. The method as defined in claim 14 wherein the inserting further comprises inserting the wire guide into the wire guide receiving slot.

16. The method as defined in claim 13 further comprising maintaining, by the wire guide, the plurality of wires in a substantially fixed relationship within the plurality of channels.

17. The method as defined in claim 11 further comprising trimming the excess wire.

18. The method as defined in claim 11 further comprising locking the first and second members to each other, wherein the first member comprises a first locking member, wherein the second member comprises a first notched edge, and wherein the first locking member engages with the first notched edge to accomplish the locking.

19. The method as defined in claim 11 further comprising trimming a jacket of a cable to expose the plurality of wires.

20. The method as defined in claim 14 further comprising coupling the jack assembly to the plurality of wires by way of a plurality of electrically conductive contact members coupled within the jack assembly, wherein each of the plurality of electrically conductive contact members have a first end configured to electrically couple to an external connector by way of the external connector receiving slot and a second end configured to electrically couple to the plurality of wires.

* * * * *